United States Patent [19]

Lacroix et al.

[11] Patent Number: 4,616,550

[45] Date of Patent: Oct. 14, 1986

[54] STRING SUPPORT AND NECK DEVICE FOR STRINGED INSTRUMENT

[76] Inventors: Roger Lacroix, 2, rue de P. J. Proudhon, Villeurbanne, F-69100; Yves Argant, 8, rue Pierre Robin, Lyon, F-69007, both of France

[21] Appl. No.: 641,966

[22] PCT Filed: Nov. 29, 1983

[86] PCT No.: PCT/FR83/00237

§ 371 Date: Jul. 30, 1984

§ 102(e) Date: Jul. 30, 1984

[87] PCT Pub. No.: WO84/02218

PCT Pub. Date: Jun. 7, 1984

[30] Foreign Application Priority Data

Nov. 29, 1982 [FR] France ..... 82 20168

[51] Int. Cl.[4] ..... G10D 1/00

[52] U.S. Cl. ..... 84/173; 84/267; 84/291; 84/293; 84/313

[58] Field of Search ..... 84/291, 173, 267, 290, 84/293, 313

[56] References Cited

U.S. PATENT DOCUMENTS

| | | | |
|---|---|---|---|
| 508,543 | 11/1893 | Hay | 84/291 X |
| 529,893 | 11/1894 | Burke | 84/291 |
| 586,032 | 7/1897 | Hartman | 84/291 X |
| 964,660 | 7/1910 | Laurian | 84/291 X |
| 1,799,696 | 4/1931 | Miller | 84/291 X |
| 3,196,730 | 7/1965 | Daniel | 84/293 |
| 3,678,795 | 7/1972 | Fullerton | 84/293 |
| 3,858,480 | 1/1975 | Schneider | 84/291 X |

*Primary Examiner*—Lawrence R. Franklin

*Attorney, Agent, or Firm*—Sandler & Greenblum

[57] ABSTRACT

The present invention is directed to a string device in which the neck is selectively positionable between the body and the head of the device in order to allow a musician to select the appropriate neck for the instrument in accordance with his desires and musical needs. The neck includes a finger board which can be formed from a material different from the neck, and metal bars such as frets can be positioned on the finger board. The necks cannot only be easily replaced, but the neck or handle is adjustable under the chords or strings even while it is attached to the body and the head of the instrument.

11 Claims, 20 Drawing Figures

STRING SUPPORT AND NECK DEVICE FOR STRINGED INSTRUMENT

BACKGROUND OF THE INVENTION

1. Field of the Invention

The present invention relates to stringed musical instruments such as, for example, guitars (acoustic, electro acoustic, electric, classical, multi-necked, Hawaiian, bass, etc.), mandolins, banjos, violins, and the like. The invention also relates to the manufacture of new types of musical instruments operating with strings which are tensioned between two supports, one support generally being referred to as the body and the other support generally being referred to as the head.

2. Discussion of Prior Art

Additionally, all stringed musical instruments of the neck type comprise one or more necks (located between the head and body of the instrument) whose role is to support the tension of the strings, to permit the selection of the vibrating lengths of the strings under the action of the fingers of the hand of a user, as well as to transmit vibrations to the body of the instrument.

The surface of the neck on which the strings are pressed by the fingers of a musician is called the finger board. This finger board can be formed from a material different from that of the neck. In the case of tempered instruments, frets (i.e., metal bars) are located on this finger board.

Due to their mechanical function, these necks are solidly attached to the body and support the head of the instrument. They are always thick and often wide, which results in numerous difficulties during playing (limited speed and dexterity, fatigue and cramps), poses numerous manufacturing problems, and limits the number of octaves per string. In the case of a musical playing of the "Hawaiian" or "bottleneck" type of instrument, the finger board and the frets are a hindrance during play.

SUMMARY OF THE INVENTION

The device, according to the invention, offers new solutions to all of these problems and opens the way for the creation of new stringed musical instruments. The invention consists in freeing one or more necks from their usual mechanical stresses by virtue of the action of one or more exterior arms.

The instruments to which the present invention is directed have a plurality of necks and a plurality of heads. It should thus be understood that when a neck or head is referred to it can also be generalized as referring to a plurality of necks and a plurality of heads.

In the same way, to facilitate the explanations herein below, the types of necks to which this invention is directed are referred to as "thin necks", in comparison with present necks which are referred to as "conventional necks".

The one or more arms permit connecting the head and body of the instrument, which are situated in such a way that they free the space necessary for the artist to play around the thin neck and the strings.

As a function of the different embodiments of the present invention, the one or more arms can have a number of characteristics as enumerated below.

The arms can be of any shape but must ensure the positioning of the head with respect to the body so as to appropriately locate the strings and possibly the thin neck.

Each arm can be divided into several parts, e.g., and can be journalled, telescopic or extensible to permit attachment of the thin neck to the body and head.

Each portion of the arm can be solid or hollow and can be made from conventional or new materials, e.g., metal, carbon, plastic or other materials. The arms can also function as resonators.

The arms can be used to mount internal or external sympathetic strings.

The arms can themselves function as conventional necks, both tempered and non-tempered, thus permitting the creation of mixed instruments having both thin and conventional necks.

The arms can aid a musician during five finger playing of the instrument from above the instrument, by providing a support point for the wrist or arm of the musician which will be parallel to the thin neck of the instrument.

The one or more thin necks can have the following characteristics:

They can have new dimensions and shapes; e.g., the thin necks can be made very thin which can give them, as a function of the materials used to form the necks, a predetermined flexibility sufficient to permit new playing of the tremolo, vibrato type of strings, even in the case of chords. In such cases the arms themselves can be tensioned between the head and the body.

The necks can be thin or wide as a function of the number of strings used, as a function of the spacing of the strings, and as a function of the morphology of the hands of the musician. It then becomes possible, among other things, to manufacture necks for children to use; and these necks can be changed when the children grow up.

The necks can be formed with sections designed as a function of the best ergonomic characteristics. The form of the sections, in combination with the possibility of extremely thin sections, will greatly facilitate the playing of beginners, as well as of experienced players like the virtuosi.

The necks can be spaced from the strings or removed so as to permit playing of the Hawaiian or bottleneck type instruments, thus preventing the neck and frets from hindering such playing.

The necks can be adjustable in height so as to adjust with precision the string-to-neck or string-to-finger board space, thus avoiding the need to use bridges and nuts which are themselves adjustable in height.

These necks can be longer than conventional necks and can easily offer up to three octaves or more per string. Like traditional necks, the present necks can be tempered or non-tempered.

The present necks can be hollow and can possibly receive sympathetic resonance strings.

The necks can be made with conventional stringed instrument making materials and means permitting known sonorities, but can equally well be made from new materials, e.g., metal, glass, crystal or carbon, and then can offer new sonorities and will play as a function of the method used to attach the necks to the head and body of the instrument.

Although according to the present invention an instrument formed from a single piece is conceived, it is evident that a number of combination of heads, bodies, arms, necks and strings used as well as of their forms, positions, composition, and the multiple possibilities of adjusting these elements with respect to each other, could be used; and this number renders impossible a present description of all possibilities offered in accordance with the present invention.

BRIEF DESCRIPTION OF THE DRAWINGS

By way of non-limiting example we shall now describe seven embodiments of the present invention.

DETAILED DESCRIPTION OF THE DRAWINGS

Figure 1:
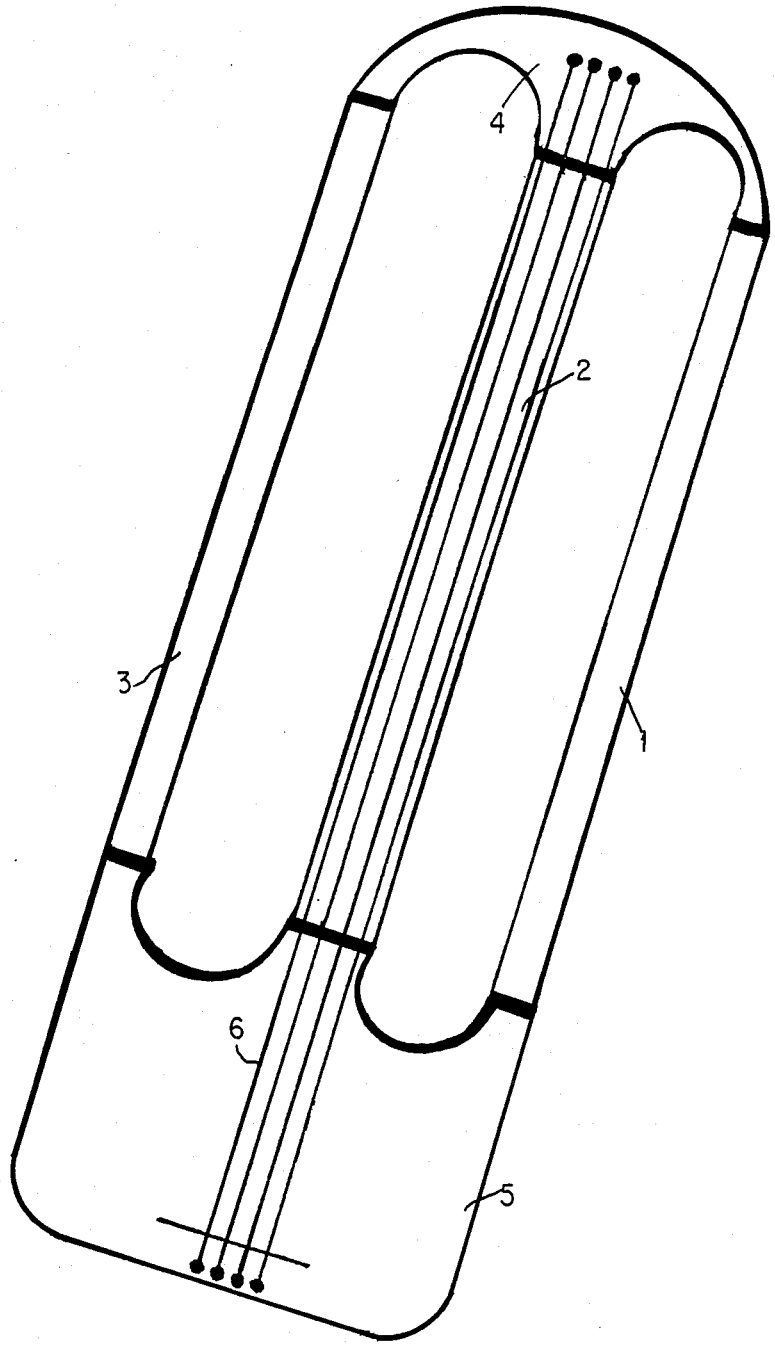
FIG. 1 is a top plan view of an instrument formed in accordance with the present invention which is drawn in basic form to illustrate with clarity the concept of the present invention.

FIG. 1 illustrates a view of a first embodiment of a device assembly formed according to the present invention which has been prepared in a basic format for clarity of comprehension.

The device of FIG. 1 comprises a first lateral arm 1 and a second lateral arm 3, the functions of which are to completely or partially free thin neck 2 from mechanical stresses. Strings 6, which are tensioned between head 4 and body 5, are attached by known conventional means which are not part of the scope of the present invention.

Figure 2:
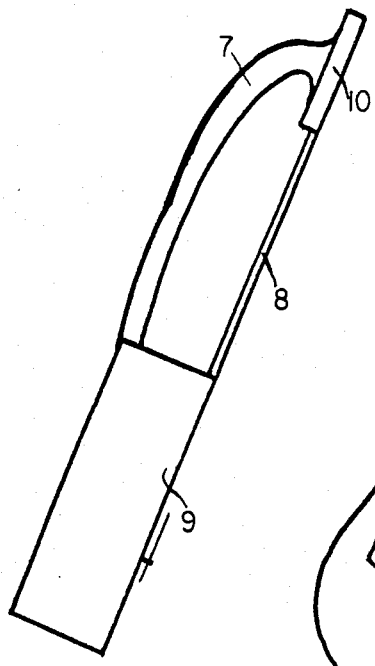
FIG. 2 is a side plan view of a musical device formed in accordance with the present invention in which an arm is positioned behind a neck.

FIG. 2 illustrates a side view of a musical device formed in accordance with the present invention comprising an arm located behind the neck.

The device illustrated in FIG. 2 comprises an arm 7 located behind thin neck 8 and attached to body 9; this arm supports head 10.

Figure 3:
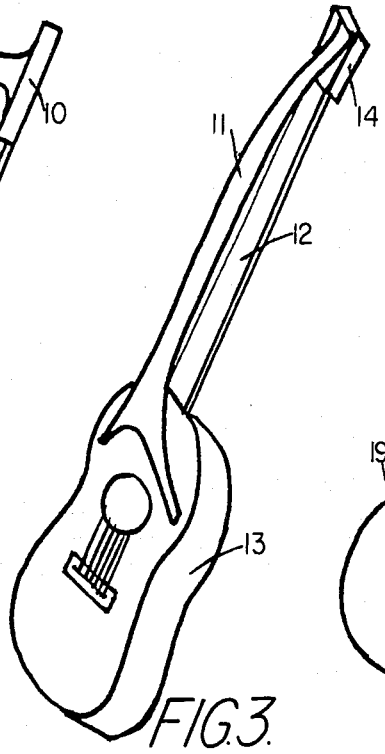
FIG. 3 is a partial top view of a musical device formed in accordance with the present invention in which an arm is located above the neck.

FIG. 3 illustrates a top view of the device formed in accordance with the present invention comprising an arm located above the neck.

The device illustrated in FIG. 3 comprises an arm 11 located above thin neck 12 and attached to body 13; this arm supports head 14. This arm is preferrably made of a rigid and transparent material.

Figure 4:
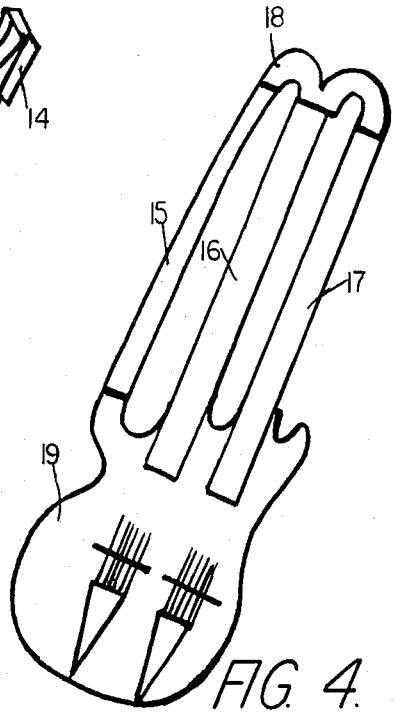
FIG. 4 is a top view of a musical device formed in accordance with the present invention in which an arm supports both a flexible and a thin neck.

FIG. 4 illustrates a top view of the device formed according to the present invention comprising an arm 15 supporting a flexible neck 16 and a thin neck 17 by a head 18. The arm is attached to body 19.

Figure 5:
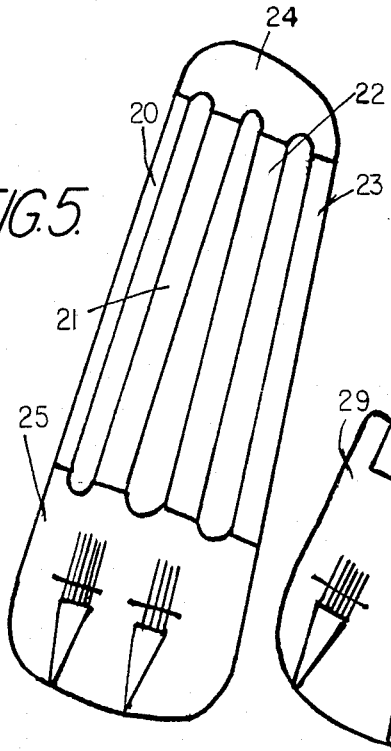
FIG. 5 is a top view of a musical device formed in accordance with the present invention in which two thin necks and two arms are provided.

FIG. 5 illustrates a top view of the device formed in accordance with the present invention comprising an arm 20, thin neck 21, thin neck 22, arm 23, head 24, and body 25.

Figure 6:
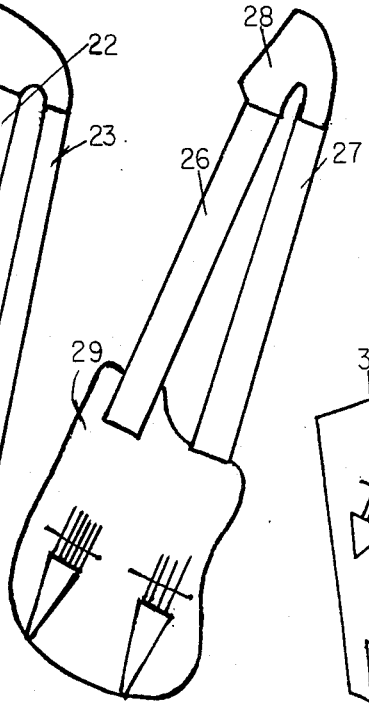
FIG. 6 is a top view of another embodiment of a musical device formed in accordance with the present invention in which an arm serves as a neck, and in which a thin neck is also provided.

FIG. 6 illustrates a top view of the device formed in accordance with the present invention comprising an arm serving as neck 26, a thin neck 27, a head 28, and a body 29.

Figure 7:
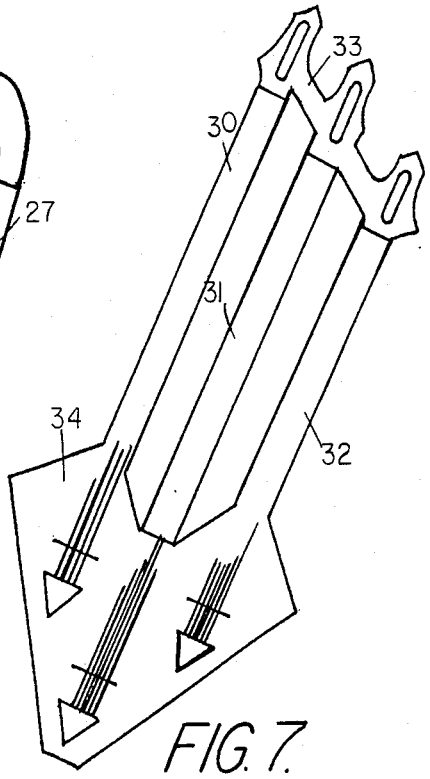
FIG. 7 is a top view of a device viewed in accordance with the present invention in which an arm functions as a neck and in which a thin neck and a neck arm are also provided.

FIG. 7 is a top view of a device formed in accordance with the present invention comprising an arm functioning as neck 30, a thin neck 31, a neck arm 32, a head 33, and a body 34.

It is thus easily understood that a device formed in accordance with the present invention can be applied to many types of existing instruments having strings and necks, e.g., all violins, violincellos, double bass, banjos, mandolins, and a very extensive range of different types of guitars, including "solid body" electric guitars, classical guitars, folk guitars, and jazz guitars.

By way of non-limiting example we shall now describe an embodiment formed in accordance with the present invention of a so-called "jazz" electric guitar.

This guitar, made in accordance with conventional methods and materials appropriate for electric jazz guitars, poses no particular manufacturing problems, as the thin neck is integrally attached to the head and the body. The solid or hollow lateral arms are made integral at their ends with the head and the body.

Figure 8:
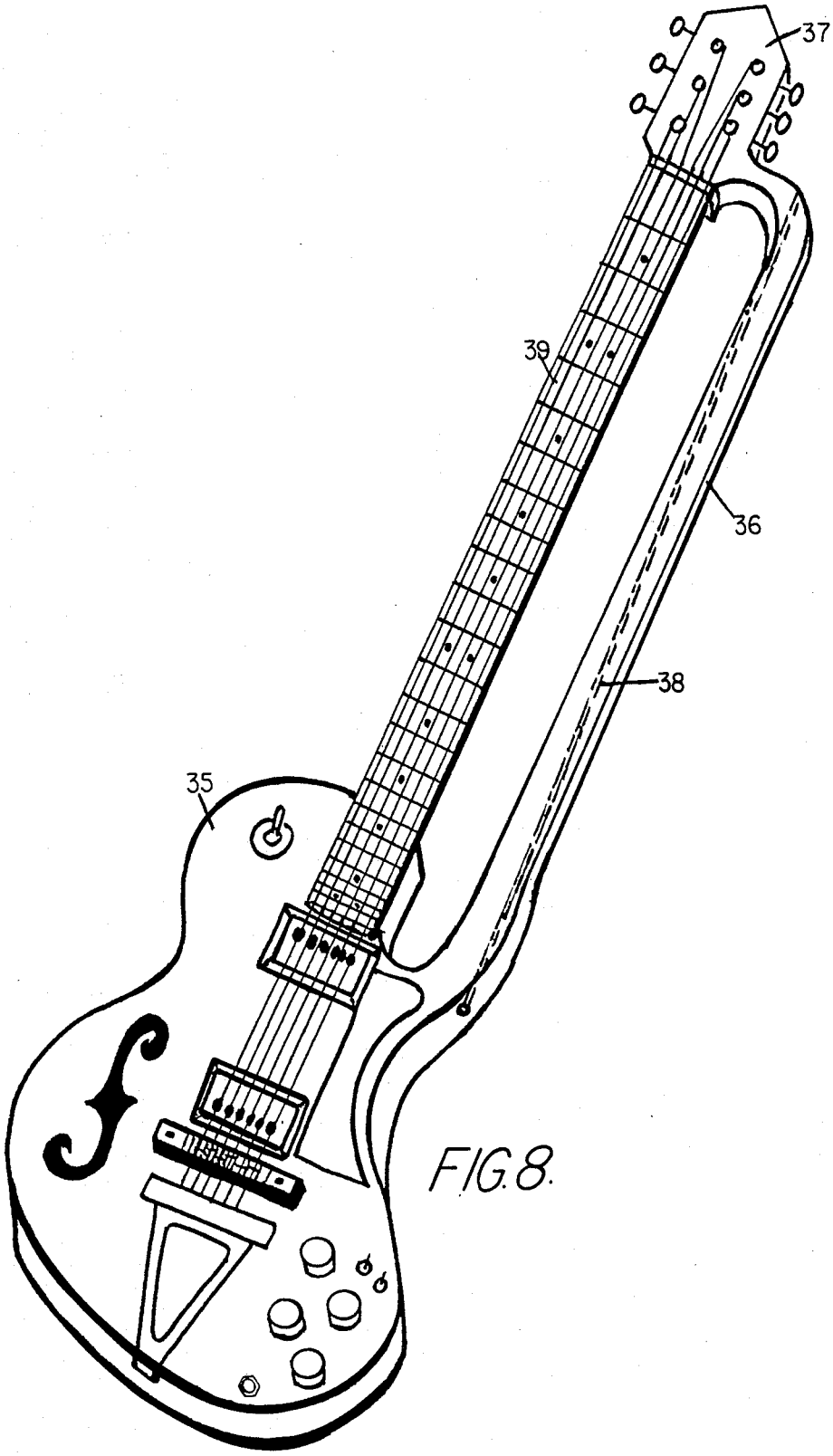
FIG. 8 is a perspective view of a "jazz electric guitar assembly"

FIG. 8 illustrates a view of a so-called "jazz electrical guitar assembly".

The device illustrated in FIG. 8 comprises a body 35 functioning as a sound chamber made of solid or hollow wood, an arm 36 formed integrally with body 35, a head 37 which is formed from solid or hollow wood and equipped with a correction screw 38 acting in response to the tension of the strings, and a thin neck 39, which is integrally attached to head 37 and body 35, and which will be formed and attached in accordance with all conventional methods, although it can be made from a substantially reduced thickness at the option of the instrument maker.

By way of non-limiting example, we shall now describe an embodiment formed in accordance with the present invention for a so-called "solid body" electric guitar (having a body of solid wood).

This instrument can be made according to conventional instrument making methods and materials appropriate for "solid body" guitars. Its principle characteristic involves a head which is positioned by two lateral arms. The tension force of the strings is thus divided in an equal manner. Additionally, given the geometric position of these arms, the tension force of the strings is only exerted in a longitudinal direction. Thus, the arms only undergo compresion forces; and these arms support the thin neck which can be made of conventional materials. The body, arms and head can thus be made of solid wood, such as ash or any other suitable wood. The manufacture of these arms is effected according to the same processes as the actual manufacturing of conventional necks. They can be made integral with the body and the head. However, the head can optionally be equipped with a slide system so as to permit adjustment of the spacing of the head from the body. The neck can also optionally be of a removable type.

Figure 9:
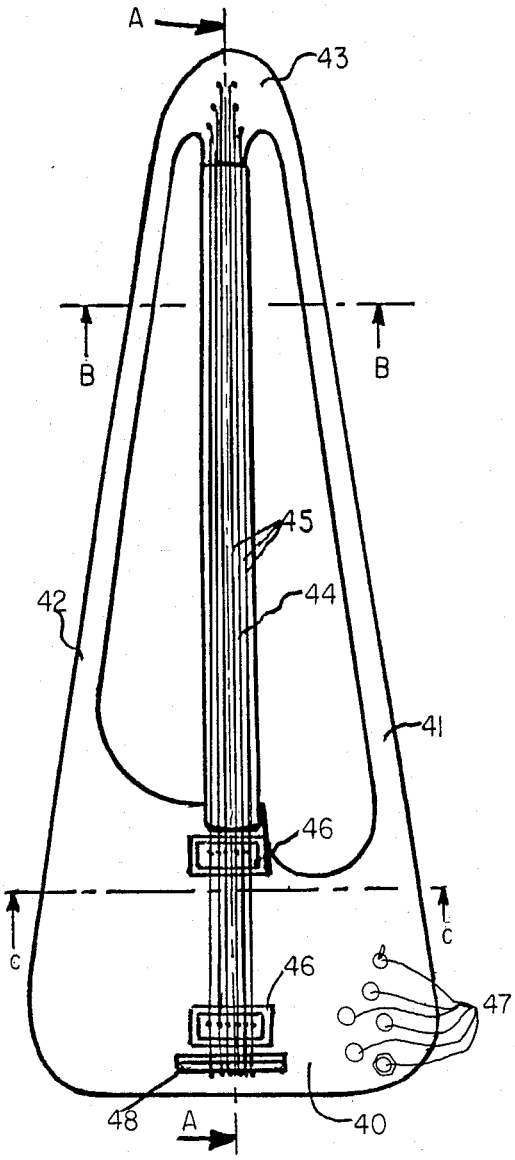
FIG. 9 is a top view of a solid body guitar formed in accordance with the present invention.

FIG. 9 illustrates a top view of a solid body guitar formed according to the present invention.

Figure 10:
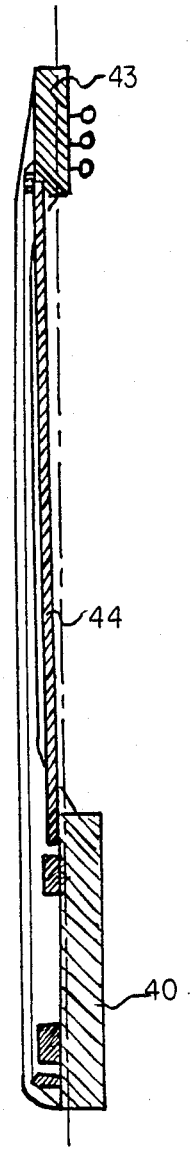
FIG. 10 is a side sectional view of the guitar of FIG. 10 taken along line A—A of FIG. 9.

FIG. 10 illustrates a side view of the guitar of FIG. 9 taken along cross-sectional line A—A.

Figure 11:
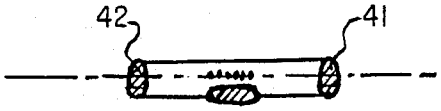
FIG. 11 is a top view of the guitar of FIG. 9 taken along line B—B of FIG. 9.

FIG. 11 illustrates a top view of a guitar taken along cross-sectional line B—B of FIG. 9.

Figure 12:
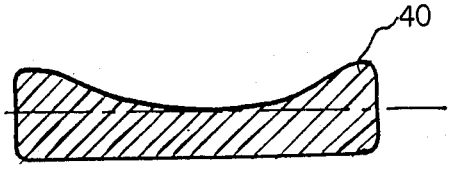
FIG. 12 is a bottom view of the guitar of FIG. 9 taken along sectional line C—C of FIG. 9.

FIG. 12 illustrates a bottom view taken along cross-sectional line C—C of FIG. 9.

The device illustrated in FIGS. 9–12 comprises a body 40, a right arm 41, left arm 42, head 43, neck 44, and strings 45, as well as the usual elements which form part of these guitars, e.g., pick-up controls 46 for electronic adjustment means 47 of bridge 48.

Body 40 is slightly concave to permit the raising of arms 41 and 42 such that the arms will be located in the plane of strings 45. Arms 41 and 42, which only work under compression, can have a reduced cross-section.

The thin neck can be removable in this case, and by way of non-limiting example we shall now describe an embodiment of such a removable neck. The material used for this neck can be conventional or new, e.g., crystal, glass, rubber, metal or carbon. A musician can thus have several necks with different characteristics and can change the necks as a function of his desires.

Figure 13:
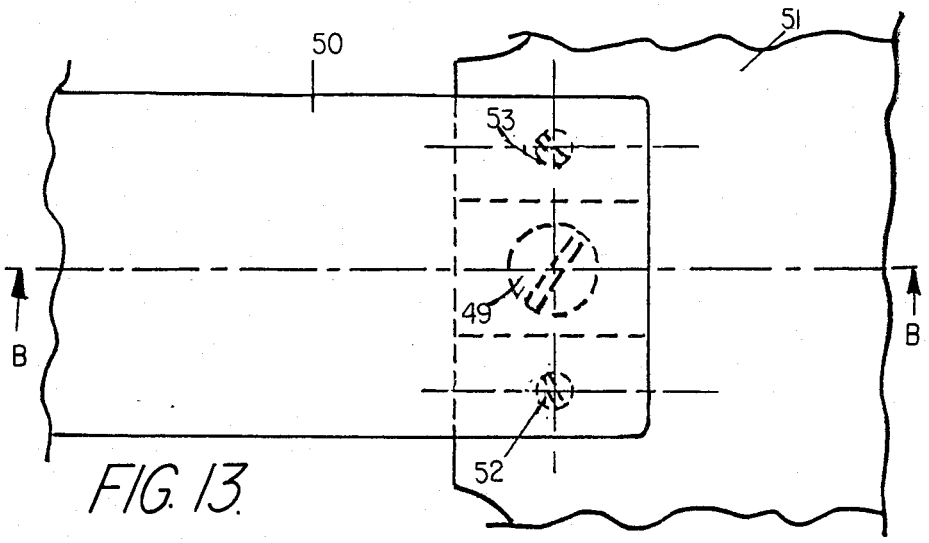
FIG. 13 is a partial plan view of a device for attaching a neck formed in accordance with the present invention to the body of a guitar.
Figure 14:
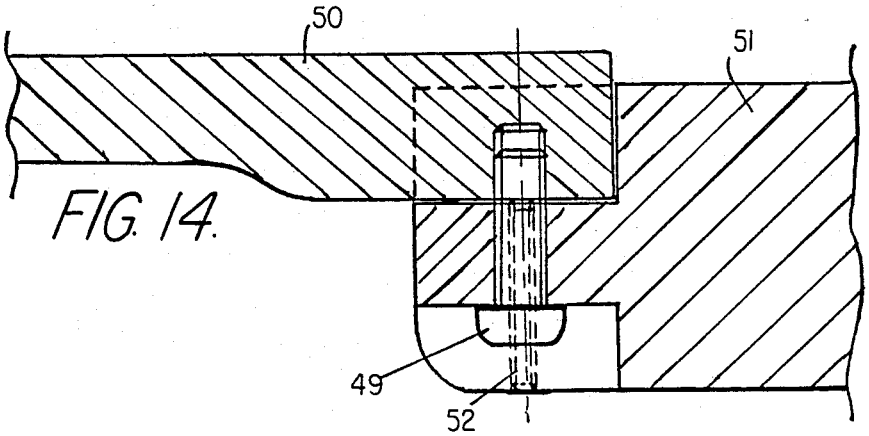
FIG. 14 is a sectional view taken along line B—B of FIG. 13.
Figure 15:
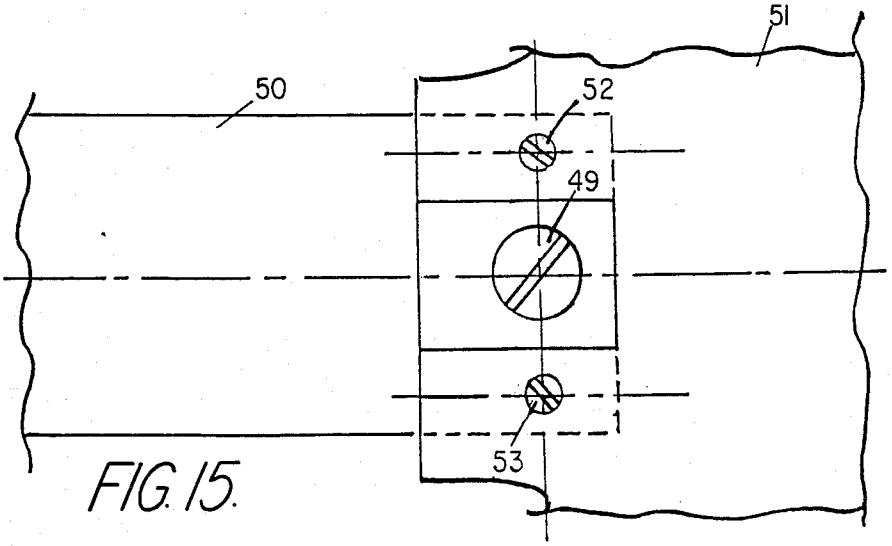
FIG. 15 is a top view of the attachment device of FIGS. 13 and 14.

FIGS. 13, 14 and 15 illustrate a device according to the present invention for attaching a neck to the body of an instrument.

The device thus illustrated in FIGS. 13, 14 and 15 comprises a guitar body 51, which is provided with a place, i.e., a recess, for receiving the end of neck 50, and with two headless screws 52 and 53 screwed into body 51, which permits the positioning of neck 50 in a recess in the body, and a screw 49 of large diameter permitting the placement of the neck against positioning screws 52 and 53. Thus, the rapid attachment of the neck, and all height and anti-twisting adjustments are rendered possible.

Figure 16:
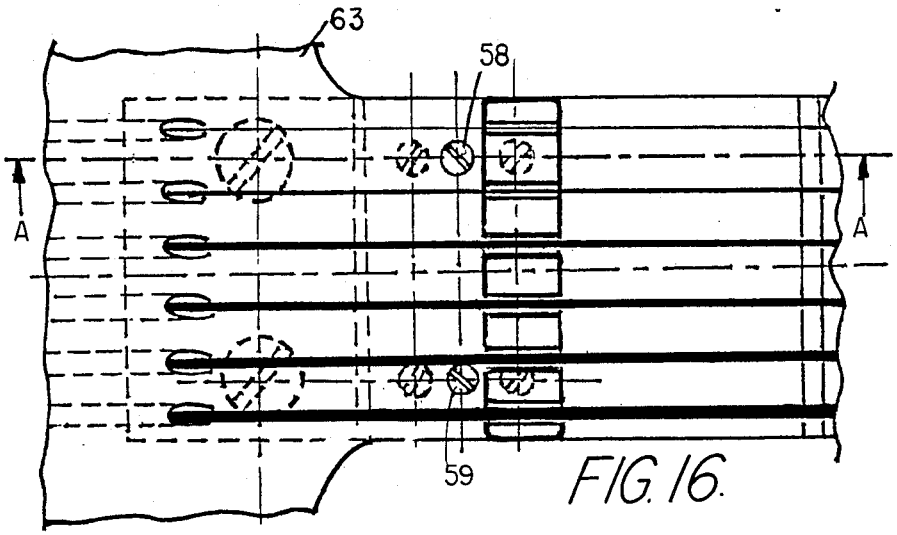
FIG. 16 is a device formed in accordance with the present invention for attaching a neck to the head of a guitar.
Figure 17:
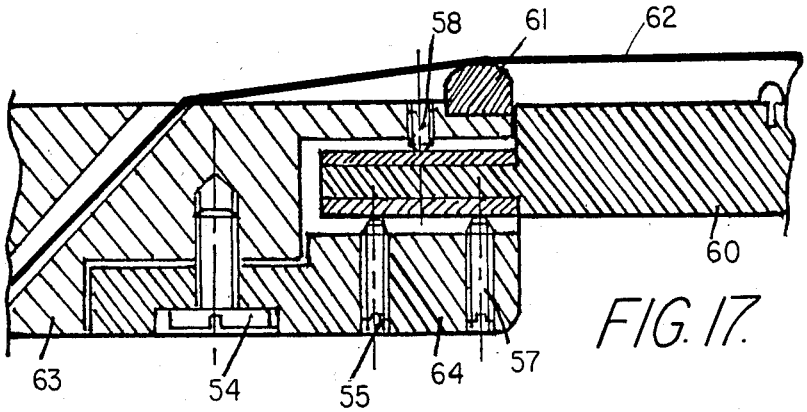
FIG. 17 is a cross sectional view of the device of FIG. 16 taken along line A—A in FIG. 16.
Figure 18:
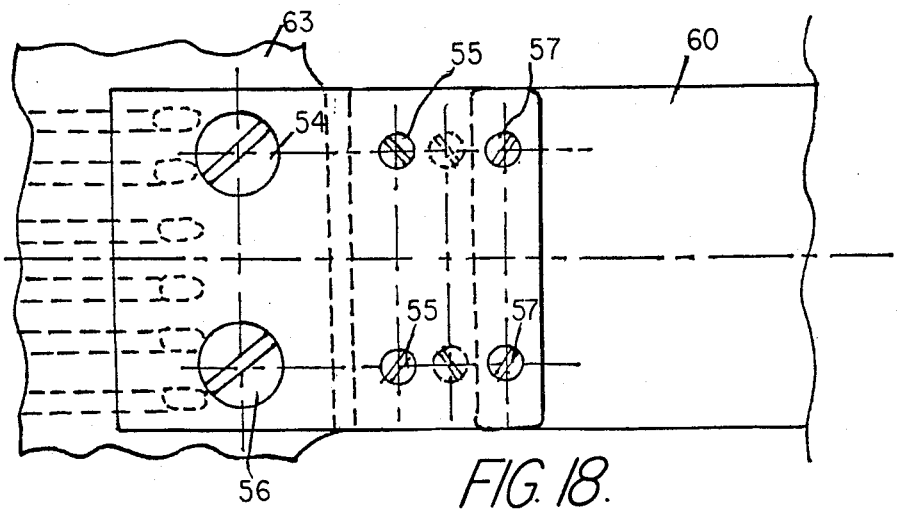
FIG. 18 is a top plan view of the device of FIG. 16.

FIGS. 16, 17 and 18 illustrate a device according to the present invention for attaching the neck to the head of an instrument.

The device thus illustrated in FIGS. 16, 17 and 18 comprises a screw system permitting the attachment of the neck to the head. Neck 60, placed in a suitable position under head 63, will be adjusted in height by two screws 58 and 59. Element 64 serves to hold neck 60 pressed against two screws 58 and 59. This element 64 will be attached to head 63 by two screws 54 and 56, respectively, and includes screws 55 and 57 for permitting the anti-vibration and anti-twisting adjustments. Strings 62 will be supported by nut 61, which is integral with head 63.

By way of non-limiting example, and to open new horizons in the manufacture of future instruments, we shall now describe a device according to the present invention made from a single piece in the form of a frame. The body, arms, head, and neck are of metal cut in a plate. The usual accessories, e.g., pick-up controls, finger boards, and mechanic or parts, have been mentioned herein.

Figure 19:
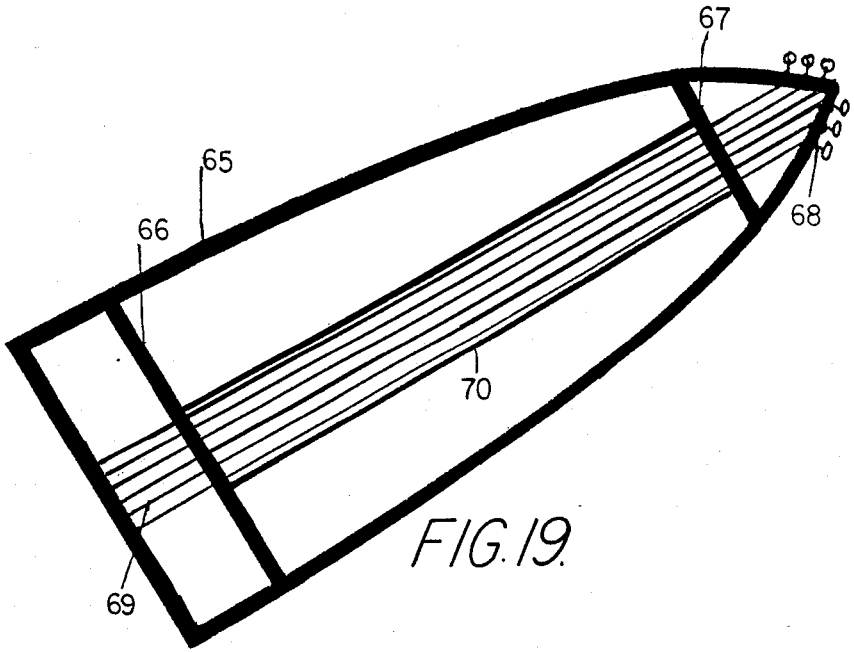
FIG. 19 is a plan view of a musical assembly formed in accordance with the present invention.

FIG. 19 illustrates a view of the device assembly according to the present invention.

The device illustrated in FIG. 19 comprises a frame 65, bridge 66, nut 67, mechanical parts 68, and a neck 70, all formed in a mass. Strings 69 are tensioned between nut 67 and bridge 66.

Figure 20:
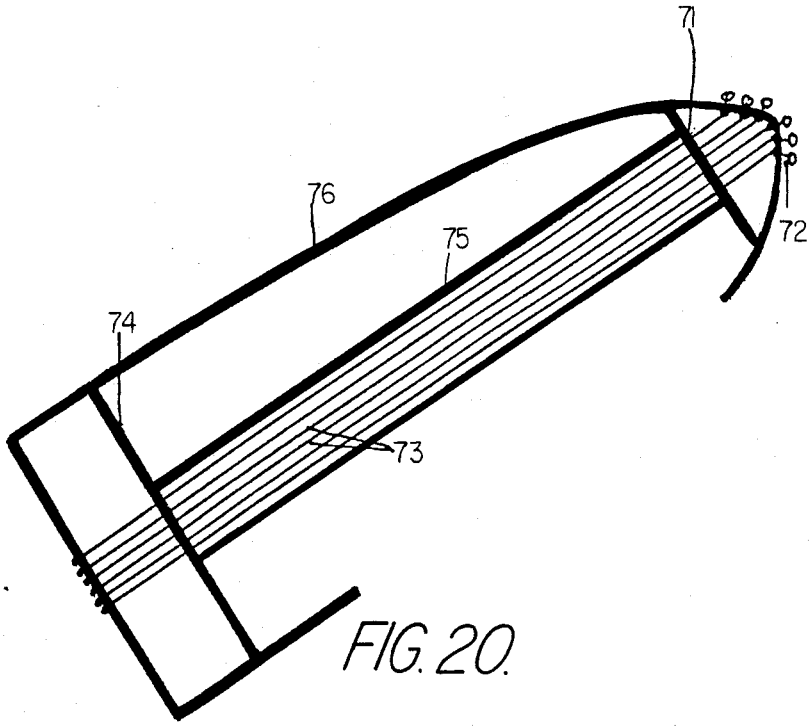
FIG. 20 is a top plan view of another embodiment of a musical assembly formed in accordance with the present invention.

FIG. 20 illustrates a view of the device assembly formed according to the invention.

The device illustrated in FIG. 20 comprises a frame 76, bridge 74, nut 71, mechanical parts 72, neck 75, and string 73 tensioned between nut 71 and bridge 74. In this example the partial frame will be formed from metal tubing. The usual accessories, e.g., pick-up controls, finger boards, and faders, are described herein.

In conclusion, it appears that the basic device according to the present invention is particularly adapted to open new horizons for instrument makers as well as for musicians.

We claim:

1. A musical instrument including a string and neck support device, said musical instrument having at least one neck and a plurality of strings, said support device comprising at least one lateral arm positioned between a head of said musical instrument and a body of said musical instrument, said at least one arm comprising means for at least partially freeing said at least one neck from mechanical stresses applied thereto, wherein said strings are tensioned between said instrument head and said instrument body, said at least one neck being rigidly yet detachably connected to said head and said body, said head and said body comprising means for rigidly and detachably receiving first and second ends, respectively, of said at least one neck, said instrument further comprising means for adjusting the spacing between said strings and said neck.

2. A musical instrument in accordance with claim 1 wherein there are at least two lateral arms connecting said head and said body.

3. A musical instrument in accordance with claim 1 further comprising a plurality of necks.

4. A musical instrument in accordance with claim 1 wherein said at least one neck is substantially thin and flexible.

5. A device in accordance with claim 1 wherein said musical instrument further comprises means for adjusting said neck against vibration and twisting.

6. A device in accordance with claim 1 wherein said at least one arm can support strings and thereby can comprise a neck.

7. A musical instrument in accordance with claim 1 wherein said head, said at least one lateral arm and said body are integrally formed into at least a partial frame.

8. A musical instrument in accordance with claim 7 wherein said frame is a complete endless frame.

9. A musical instrument in accordance with claim 1 wherein said head and said body each comprise recesses for detachably receiving first and second ends of said neck, respectively.

10. A musical instrument in accordance with claim 9 wherein said body comprises a splined portion for receiving a second end of said neck, said second end of said neck further comprising a recess for receiving a fastener, said musical instrument further comprising a fastener adapted to be inserted within said splined portion of said body through an aperture in said splined portion and into an aperture in said neck to adjustably position said said neck with respect to said body.

11. A musical instrument in accordance with claim 9 wherein said head recess comprises a slot adapted to receive a narrowed end portion of said neck, said neck being attached to said head by a plurality of adjusting screws, two of said adjusting screws being positioned in a generally L-shaped element forming a portion of said head defining said slot, said L-shaped element being attached to said head by an adjustable screw.

* * * * *